US005619314A

United States Patent [19]

Kubo

[11] Patent Number: 5,619,314

[45] Date of Patent: Apr. 8, 1997

[54] IMAGE FORMING APPARATUS

[75] Inventor: Takahiro Kubo, Tokyo, Japan

[73] Assignee: Canon Kabushiki Kaisha, Tokyo, Japan

[21] Appl. No.: 501,886

[22] Filed: Jul. 13, 1995

Related U.S. Application Data

[63] Continuation of Ser. No. 391,079, Feb. 21, 1995, abandoned, which is a continuation of Ser. No. 257,672, Jun. 8, 1994, abandoned.

[30] Foreign Application Priority Data

Jun. 10, 1993 [JP] Japan ..... 5-163826

[51] Int. Cl.[6] ..... G03G 15/14

[52] U.S. Cl. ..... 399/296; 15/256.51

[58] Field of Search ..... 355/271, 273, 355/326 R, 327, 23, 24, 320, 319; 15/256.51, 256.52, 256.53; 118/652

[56] References Cited

U.S. PATENT DOCUMENTS

| | | | |
|---|---|---|---|
| 4,501,484 | 2/1985 | Shimura | 355/301 |
| 5,057,873 | 10/1991 | Sawai et al. | 355/271 |
| 5,069,128 | 12/1991 | Hara et al. | 15/256.51 X |
| 5,182,603 | 1/1993 | Yamada | 355/273 |
| 5,249,024 | 9/1993 | Menjo | 355/271 X |
| 5,298,953 | 3/1994 | Lindblad et al. | 355/271 |
| 5,319,423 | 6/1994 | Takeda et al. | 355/271 |
| 5,335,052 | 8/1994 | Sato et al. | 355/271 |
| 5,534,983 | 7/1996 | Kubo | 355/271 |
| 5,550,620 | 8/1996 | Kimura et al. | 355/273 |

FOREIGN PATENT DOCUMENTS

| | | |
|---|---|---|
| 0488147 | 6/1992 | European Pat. Off. . |
| 59-55469 | 3/1984 | Japan . |
| 60-218681 | 11/1985 | Japan . |
| 3-51872 | 3/1991 | Japan . |
| 3-171188 | 7/1991 | Japan . |
| 4-361288 | 12/1992 | Japan . |
| 4-195173 | 11/1995 | Japan . |

OTHER PUBLICATIONS

Patent Abstracts of Japan, vol. 010, No. 084 (P–442) Apr. 3, 1986.

Patent Abstracts of Japan, vol. 016, No. 522 (P–1445) Oct. 27, 1992.

Patent Abstracts of Japan, vol. 008, No. 157 (P–288) Jul. 20, 1984.

Patent Abstracts of Japan, vol. 015, No. 201 (P–1205) May 23, 1991.

*Primary Examiner*—Matthew S. Smith

*Attorney, Agent, or Firm*—Fitzpatrick, Cella, Harper & Scinto

[57] ABSTRACT

An image forming apparatus includes: image forming mechanisms for forming a toner image on a recording material at a recording position, a convey mechanism having a recording material bearing member for bearing the recording material for conveying the recording material to the recording position, a first cleaning device having a brush-shaped cleaning member slidingly contacted with a surface of the recording material bearing member for cleaning the surface of the recording material bearing member, and a second cleaning device having an oil absorber member abutted against the surface of the recording material bearing member for cleaning the surface of the recording material bearing member. The oil absorber member is abutted against the surface of the recording material bearing member at a side opposite to a side where the toner is scattered due to the sliding contact between the brush-shaped cleaning member and the surface of the recording material bearing member.

68 Claims, 4 Drawing Sheets

IMAGE FORMING APPARATUS

RELATED APPLICATIONS

This application is a continuation of prior application Ser. No. 08/391,079 filed Feb. 21, 1995, which is a continuation of prior application Ser. No. 08/257,672 filed on Jun. 8, 1994, both of which are now abandoned.

BACKGROUND OF THE INVENTION

1. Field of the Invention

The present invention relates to an image forming apparatus such as a copying machine, a laser beam printer and the like, and more particularly, it relates to an image forming apparatus having a recording material bearing member for conveying a recording material to a position where a toner image is formed on the recording material.

2. Related Background Art

An image forming apparatus in which a toner image is formed on a recording material, an image forming technique wherein a recording material is borne on a recording material bearing member and a toner image is formed on the recording material while the recording material bearing member is being moved has been proposed. Particularly, this technique is frequently applied to a color copying machine wherein toner images having different colors are superimposed on a recording material to obtain a full-color image. An example of such a color copying machine is shown in FIG. 6.

In a color copying machine shown in FIG. 6, an electrostatic latent image is formed on a photosensitive drum 50 by illuminating light corresponding to image information onto the photosensitive drum which has been charged positively or negatively, by means of an exposure means 51. The latent image is developed by a developing means 52 as a toner image which is in turn transferred onto a recording medium 53. In order to successively transfer a plurality of toner images onto the recording medium 53, the recording medium 53 is wound around a transfer drum (recording medium bearing member) 54 and the plural toner images are successively transferred onto the recording medium 53 while the transfer drum 54 is being rotated.

In order to utilize the resources effectively in such a color copying machine, it is desirable to form the toner images on both surfaces of the recording medium. In this case, it is considered that, after the toner is transferred to the surface of the recording medium 53, the recording medium 53 is sent by a convey means (not shown) to a fixing means where the toner image is fixed to the recording medium, and then the recording medium is wound around the transfer drum 54 again so that a new toner image can be transferred onto the other surface of the recording medium 53.

On the other hand, in fixing devices for fixing a toner image to a recording material such as fixing devices which comprise a fixing roller and a pressure roller and in which a toner image is fixed to a recording material by heat and pressure while the recording material is being moved by these rollers, oil is generally coated on the roller or rollers to prevent the offset of toner. Accordingly, once the toner image is fixed to the recording material, the oil is adhered to the recording material.

In order to form the toner images on both surfaces of the recording material, when the recording material to which the oil was adhered is wound around the transfer drum again, the oil is also adhered to a peripheral surface of the transfer drum. As a result, the oil will also be adhered to a peripheral surface of the photosensitive drum contacted with the peripheral surface of the transfer drum. If the oil is adhered to the photosensitive drum, due to the viscosity of the oil, the toner will not be transferred from the photosensitive drum to the recording material or the toner will be adhered to an area of the photosensitive drum to which the toner is not normally adhered. Consequently, an output image becomes thinner than a desired image or the fog occurs in the output image. Particularly, in apparatuses for forming a color image, since a larger amount of oil is required to prevent the offset of toner in comparison with apparatus for forming a monocolor image, the reduction in density of the output image or the fog is apt to occur.

On the other hand, the toner adhered to non-image forming areas of the photosensitive drum, i.e., areas on the peripheral surface of the photosensitive drum between images (formed on the drum) or areas on the photosensitive drum disposed outside the image forming area in a generatrix direction of the drum will also be transferred from the photosensitive drum to the transfer drum. Accordingly, when the function capable of forming the toner images on both surfaces of the recording material is added to the image forming apparatus, before the oil is transferred from the peripheral surface of the transfer drum to the peripheral surface of the photosensitive drum, the oil mixed with the toner must be removed from the peripheral surface of the transfer drum.

The oil mixed with the toner may be removed by using a fur brush or a web-shaped cloth. However, the oil cannot be removed completely by the fur brush alone; whereas, when the web is used alone, the service life of the web is very short because the toner is adhered to the web, and, thus, the web cannot be put to the practical use. Thus, it is considered that both the fur brush and the web are used simultaneously.

However, in order to remove the toner adhered to the transfer drum, it is necessary to slidingly contact the fur brush with the recording material bearing member with high relative speed, so that the scraped toner is apt to be scattered (in a direction A in FIG. 6). Although it is considered that a peripheral surface of the fur brush 55 is enclosed by a cover 56 to prevent the scattered toner from spreading (FIG. 6), since the cover 56 should not be contacted with the transfer drum, the toner is scattered through a clearance between the cover and the transfer drum. If the web is enclosed by a cover similarly, since there is clearance between the cover and the transfer drum, it is impossible to completely prevent the toner scattered from the fur brush from being adhered to the web.

SUMMARY OF THE INVENTION

The present invention aims to eliminate the above-mentioned conventional drawback, and an object of the present invention is to provide an image forming apparatus which can effectively remove toner and oil from a recording material bearing member.

Another object of the present invention is to provide an image forming apparatus which can prevent the service life of a brush-shaped cleaning member and an oil absorber from being shortened.

A further object of the present invention is to provide an image forming apparatus in which a brush-shaped cleaning member is slidingly contacted with a surface of a recording material bearing member and an oil cleaner is abutted against the surface of the recording material bearing member at a side opposite to a side where toner is scattered.

The other objects of the present invention will be apparent from the following description referring to the accompanying drawings.

DETAILED DESCRIPTION OF THE PREFERRED EMBODIMENTS

Figure 1:
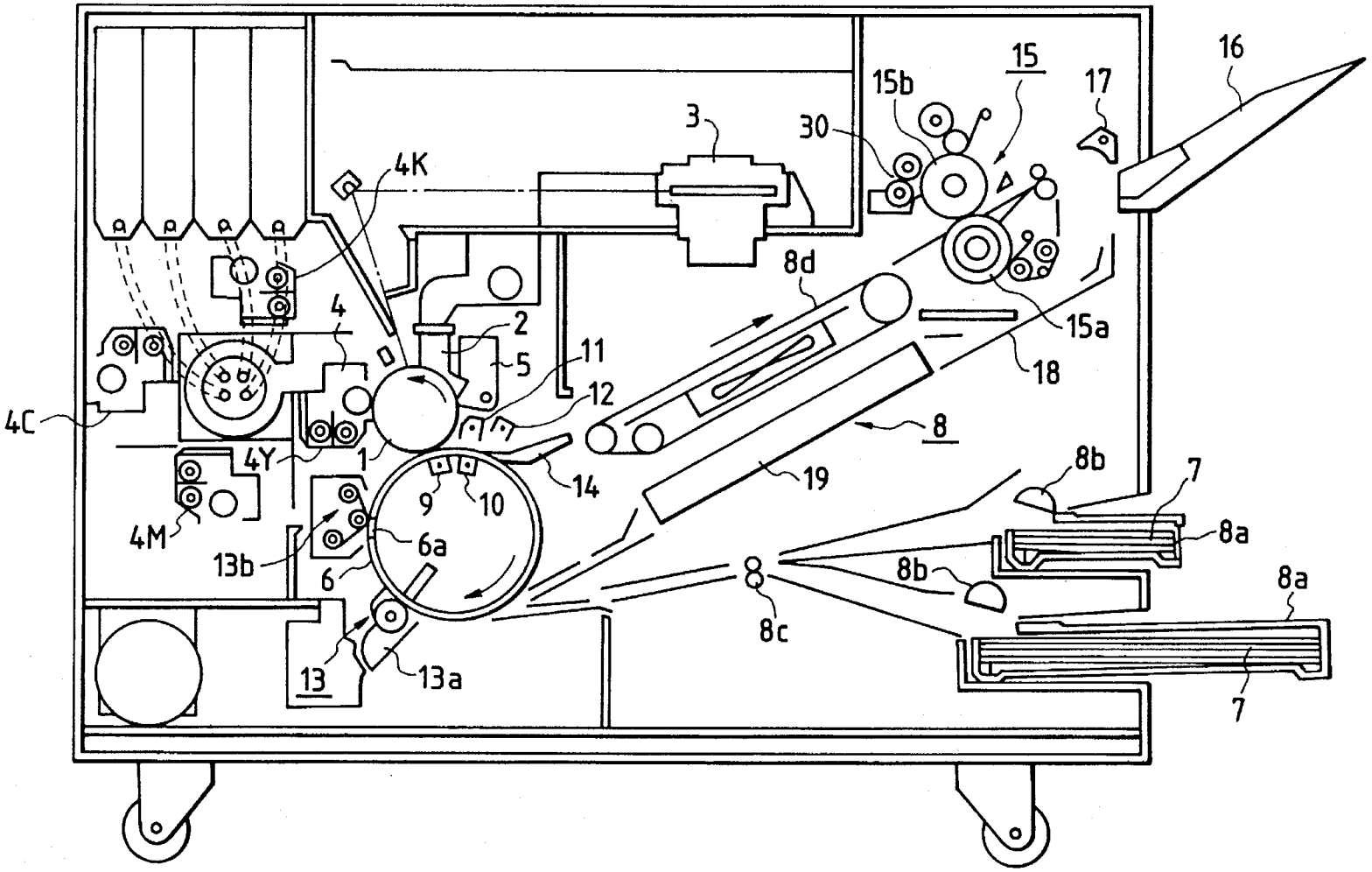
FIG. 1 is an elevational sectional view of an image forming apparatus according to a first embodiment of the present invention.
Figure 2:
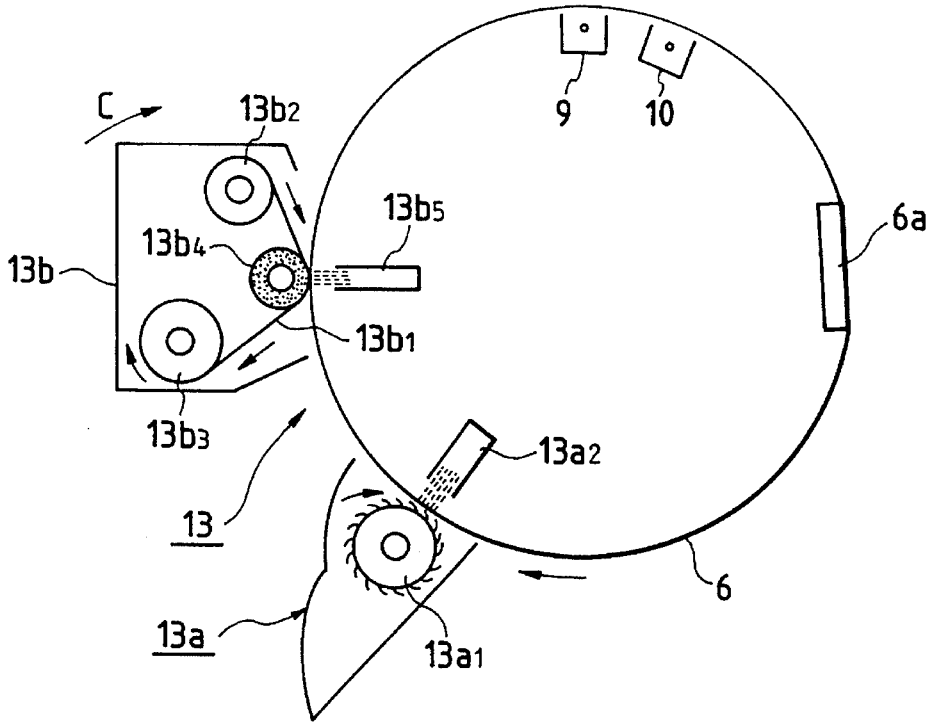
FIG. 2 is a sectional view showing the first embodiment wherein a fur brush and a web cleaner are used as a cleaning means for cleaning a transfer drum.

Now, a first embodiment of the present invention will be fully explained with reference to FIGS. 1 and 2. Incidentally, FIG. 1 is an elevational sectional view of an image forming apparatus, and FIG. 2 is a sectional view showing a cleaning means for cleaning a transfer drum. The entire construction of the image forming apparatus will be firstly explained, and then the cleaning means for cleaning the transfer drum will be described.

The image forming apparatus shown in FIG. 1 is an apparatus capable of forming a full-color image and comprises a photosensitive drum (image bearing member) 1 which is rotatably mounted and is rotated in a direction shown by the arrow, and a process means disposed around the photosensitive drum and adapted to form an image. The process means may comprise various means, and, in the illustrated embodiment, it comprises a first charge means 2 for uniformly charging the photosensitive drum 1, an exposure means 3 such as a laser beam emitting means for illuminating a color-decomposed light image or equivalent light image onto the photosensitive drum to form an electrostatic latent image on the drum, a rotatable developing means 4 for visualizing the electrostatic latent image on the photosensitive drum 1 as a toner image, and a cleaning means 5 for removing residual toner (developer) remaining on the 10 photosensitive drum 1.

The developing means 4 comprises four developing devices 4Y, 4M, 4C, 4K containing yellow toner, magenta toner, cyan toner and black toner, respectively, and a substantially cylindrical support which is rotatably supported hold these developing devices. The developing means 4 is so operated that a desired developing device is opposed to a peripheral surface of the photosensitive drum by rotating the cylindrical support to develop the electrostatic latent image, thereby permitting the formation of four color toner images for a full-color image.

The visualized image (toner image) formed on the photosensitive drum 1 is transferred onto a recording material (sheet) 7 born and conveyed by a transfer drum (recording material bearing member) 6 at a recording position where the transfer drum 6 is contacted with the photosensitive drum 1 when the recording material 7 is born by the transfer drum 6. The transfer drum 6 is rotatably mounted, and a bearing member for bearing the recording material 7 is provided on an outer peripheral surface of the transfer drum. The bearing member is formed from a dielectric sheet made of polyethylene terephthalate, polyvinylidene fluoride resin or the like. Further, the transfer drum 6 has a gripper **6*a* for gripping the recording material 7 conveyed by a convey means 8. Further, a transfer discharger 9 and an inner electricity removal discharger 10 are arranged within the transfer drum 6 and outer electricity removal dischargers 11, 12** are arranged outside the transfer drum. These electricity removal dischargers constitute an electricity removal means.

Further, around the transfer drum 6, at a predetermined position, there is arranged a cleaning means 13 (**13*a*, 13*b*) for cleaning the drum 6**. This cleaning means will be fully described later.

The convey means 8 comprises a pick-up roller **8*b* for picking up and separating the recording materials 7 stacked in a cassette 8*a* one by one, and feed rollers 8*c* for feeding the separated recording material to the transfer drum 6. The recording material 7 which was wound around the transfer drum 6 and to which the toner image was transferred is separated from the transfer drum 6 by a separation pawl 14, and the separated recording material is sent, by a convey belt 8*d*, to a fixing means 15, where the toner image is fixed to the recording material 7. The fixing means 15 comprises a pressure roller 15*a* and a fixing roller 15*b* so that the toner image transferred to the recording material 7 can be fixed to the recording material with heat and pressure while the recording material is being passed between the rollers 15*a*, 15*b***.

Silicone oil having good mold releasing ability is coated on the fixing roller **15*b* by an oil applying member 30**, thereby preventing the offset of toner.

In a single-face copy mode in which the image is formed on one surface of the recording material 7 alone, the recording material 7 outputted from the fixing means 15 is discharged onto a discharge tray 16. On the other hand, in a both-face copy mode in which the images are formed on both surfaces of the recording material 7, the recording material 7 outputted from the fixing means 15 is guided to a convey guide 18 by a rockable guide member 17 and is temporarily stored in a recording material stocker 19. Then, the recording material is wound around the transfer drum 6 again so that the surface of the recording material on which the image was formed is closely contacted with the transfer drum 6, and then, an image is formed on the back surface of the recording material in the same manner as described above.

As mentioned above, the silicone oil is adhered to the recording material outputted from the fixing means 15. Thus, when the recording material is closely contacted with the transfer drum 6, the oil is transferred onto the surface of the transfer drum. In consideration of the above, in the illustrated embodiment the surface of the transfer drum 6 is cleaned by the cleaning means 13.

Next, the cleaning means 13 will be explained. As shown in FIG. 2, the cleaning means 13 comprises a fur brush cleaner (first cleaning means) **13*a* for scraping the toner adhered to the surface of the transfer drum 6, and a web cleaner or oil absorber (second cleaning means) 13b for sweeping the oil adhered to the transfer drum 6**. In the illustrated embodiment, a brush $13a_1$ of the fur brush cleaner is made of nylon. Further, a web $13b_1$ of the web cleaner is formed from non-woven fabric having fibers made of nylon and polyester.

As shown in FIG. 2, the brush $13a_1$ of the fur brush cleaner 13a is rotated in the same direction as the rotating direction of the transfer drum 6. That is to say, in a contact area between the dielectric sheet on the peripheral surface of the transfer drum 6 and the fur brush, the fur brush is shifted in a direction opposite to a shifting direction of the dielectric sheet. Further, the dielectric sheet is urged from inside of the transfer drum toward outside of the drum by a cleaning aiding means $13a_2$ so that the toner can easily be scraped by the fur brush $13a_1$.

Further, the web cleaner 13b comprises a supply roller $13b_2$ from which the web $13b_1$ is supplied, a drive and take-up roller $13b_3$ onto which the web is wound, and a sponge urging member $13b_4$ for urging the web $13b_1$ against the transfer drum 6 to maintain a predetermined nip (about 2 mm in the illustrated embodiment) therebetween. In use, the web cleaner 13b is rotated around a fulcrum (not shown) in a direction shown by the arrow C in FIG. 2 to urge the web $13b_1$ against the transfer drum 6 during which the drive roller $13b_3$ is rotated to wind the web $13b_1$ thereon. As a result, the surface of the transfer drum 6, i.e., the dielectric sheet is rubbed by the web $13b_1$, thereby removing the oil from the transfer drum. Incidentally, in FIG. 2, the reference numeral $13b_5$ denotes a cleaning aiding means similar to the aiding means $13a_2$.

In the cleaning means 13, since the rotating direction of the fur brush $13a_1$ is the same as the rotating direction of the transfer drum 6, almost all of the scraped toner is scattered in an upstream side of the rotating direction of the transfer drum 6. Thus, in the illustrated embodiment, the web cleaner 13b is arranged at a downstream side of the fur brush cleaner 13a in the rotating direction of the transfer drum 6. That is to say, the web cleaner 13b is disposed at a side opposite to a side where the toner is scattered by the rotation of the fur brush $13a_1$. With this arrangement, the toner scattered by the rotation of the fur brush $13a_1$ is prevented from flying up to the web cleaner 13b.

Further, in the illustrated embodiment, the toner is firstly removed from the transfer drum by the fur brush cleaner 13a and then the oil is removed from the transfer drum by the web cleaner 13b. Accordingly, the toner clogging of the web can be minimized, thereby extending the service life of the web cleaner 13b.

Incidentally, if the rotating direction of the fur brush $13a_1$ is opposite to the rotating direction of the transfer drum 6, i.e., if the fur brush $13a_1$ is shifted in the same direction as the dielectric sheet in the contact area between the fur brush $13a_1$ and the dielectric sheet, almost all of the toner scraped by the rotation of the fur brush $13a_1$ will be scattered in a downstream side of the rotating direction of the transfer drum 6. In this case, the web cleaner 13b may be arranged at an upstream side of the fur brush cleaner 13a in the rotating direction of the transfer drum 6. Also with this arrangement, it is possible to reduce an amount of the toner (scattered from the fur brush $13a_1$) adhered to the web $13b_1$. However, it is more desirable that the shifting direction of the surface of the fur brush is opposite to the shifting direction of the dielectric sheet of the transfer drum 6 since the toner removing ability is more increased. Thus, it is more desirable that the web is arranged at the downstream side of the fur brush in the rotating direction of the transfer drum 6.

Incidentally, in the illustrated embodiment, the fur brush $13a_1$ and the web $13b_1$ can be separated from the dielectric sheet of the transfer drum. Now, the contacting and separating timing of the fur brush and the web with respect to the dielectric sheet will be explained.

While the toner image is being formed on the recording material 7 wound around the transfer drum 6, both of the fur brush $13a_1$ and the web $13b_1$ are separated from the peripheral surface (dielectric sheet) of the transfer drum. After all of the different color toner images are formed on the recording material 7, the recording material is separated from the transfer drum 6 by the separation pawl 14. After a tip end of the recording material (in a conveying direction) is separated from the transfer drum, both of the fur brush $13a_1$ and the web $13b_1$ are contacted with the dielectric sheet to start the cleaning of the dielectric sheet. More preferably, immediately before a portion of the dielectric sheet on which the tip end of the recording material was born reaches a cleaning position of the fur brush, the fur brush $13a_1$ and the web $13b_1$ are contacted with the dielectric sheet. In this case, regarding any size of the recording material available to the image forming apparatus, so long as a trailing end of the recording material passes through a contact position between the fur brush $13a_1$ and the dielectric sheet and a contact position between the web $13b_1$ and the dielectric sheet, since the web and the fur brush are not contacted with the recording material, the toner image formed on the recording material is not distorted. Thus, it is more preferable.

After the transfer drum 6 is cleaned through about one revolution, both of the fur brush $13a_1$ and the web $13b_1$ are separated from the surface of the transfer drum 6. Incidentally, in the one-face copy mode, only the fur brush is contacted with the surface of the transfer drum; whereas, in the both-face copy mode, both of the fur brush and the web are contacted with the surface of the transfer drum.

Next, a second embodiment of the present invention will be explained with reference to FIG. 3.

Figure 3:
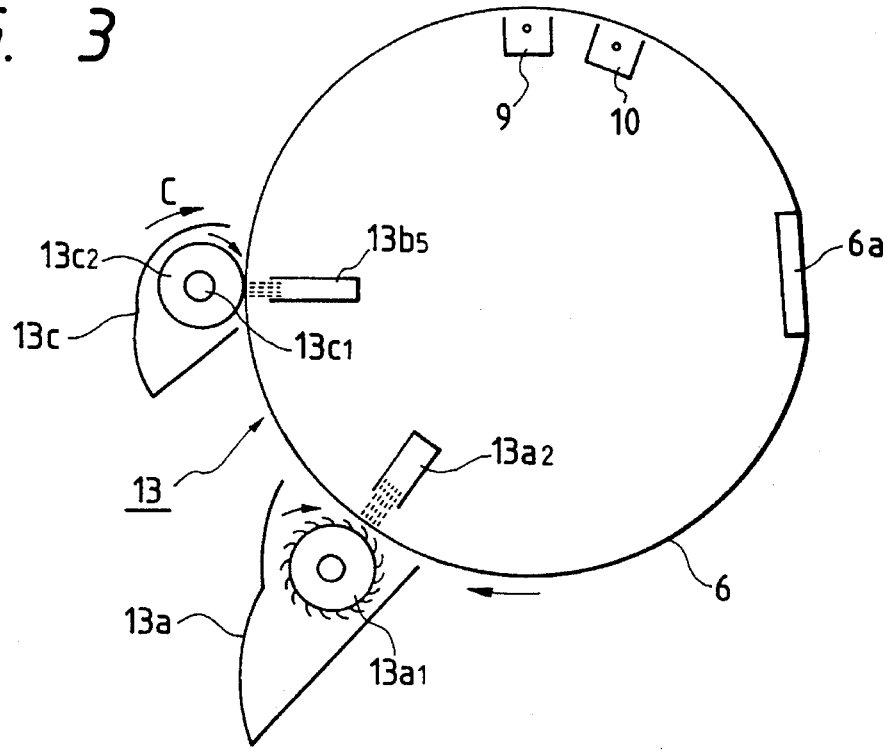
FIG. 3 is a sectional view showing a second embodiment wherein a fur brush cleaner and a roll cleaner are used as a cleaning means for cleaning a transfer drum.

In the above-mentioned first embodiment, while an example that the web cleaner 13b having the web $13b_1$ slidingly contacted with the transfer drum is used as the cleaner for removing the oil was explained, as shown in FIG. 3, a roll cleaner (oil absorber) 13c comprised of non-woven fabric $13c_2$ wound around a metal core $13c_1$ in a rolled fashion may be used. In use, the roll cleaner 13c is rocked around a fulcrum (not shown) in a direction shown by the arrow C to urge the non-woven fabric $13c_2$ against the transfer drum 6. When the roll cleaner is rotated in a clockwise direction, the oil on the transfer drum 6 can be removed.

By using this roll cleaner 13c, the cleaner can be made more compact in comparison with the web cleaner 13b in the first embodiment.

Also in the second embodiment, the second cleaning means or roll cleaner 13c is arranged at a side opposite to a side where the toner is scattered by the rotation of the fur brush $13a_1$. However, unlike the second cleaning means of the type that the web is successively wound around one of the rollers (to always contact a new portion of the web) as the first embodiment, since the peripheral surface of the roll cleaner is repeatedly used to remove the oil, the adhesion of the toner to the roll cleaner must be avoided more severely in comparison with the web cleaner. Thus, it is preferable that the roll cleaner 13c is arranged at a downstream side of the fur brush $13a_1$ in the rotating direction of the transfer drum. In this case, the rotating direction of the fur brush is the same as the rotating direction of the transfer drum.

Further, it is more preferable that the fur brush and the roll cleaner are contacted with or are separated from the transfer drum at the same time as the first embodiment.

Figure 4:
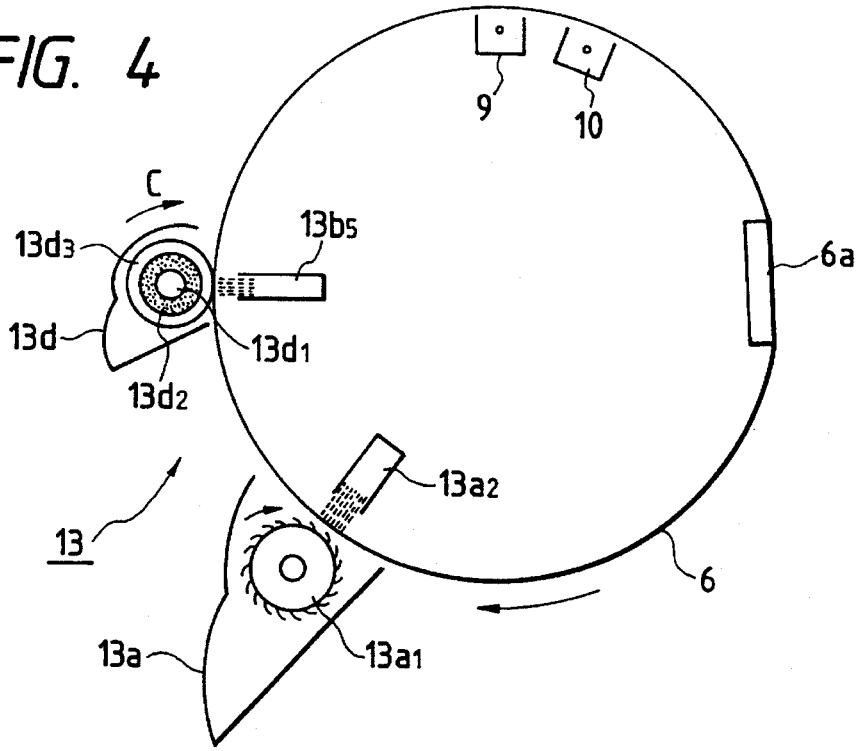
FIG. 4 is a sectional view showing an alteration wherein a fur brush cleaner and a roll cleaner are used as a cleaning means for cleaning a transfer drum and the roll cleaner has elasticity.
Figure 6:
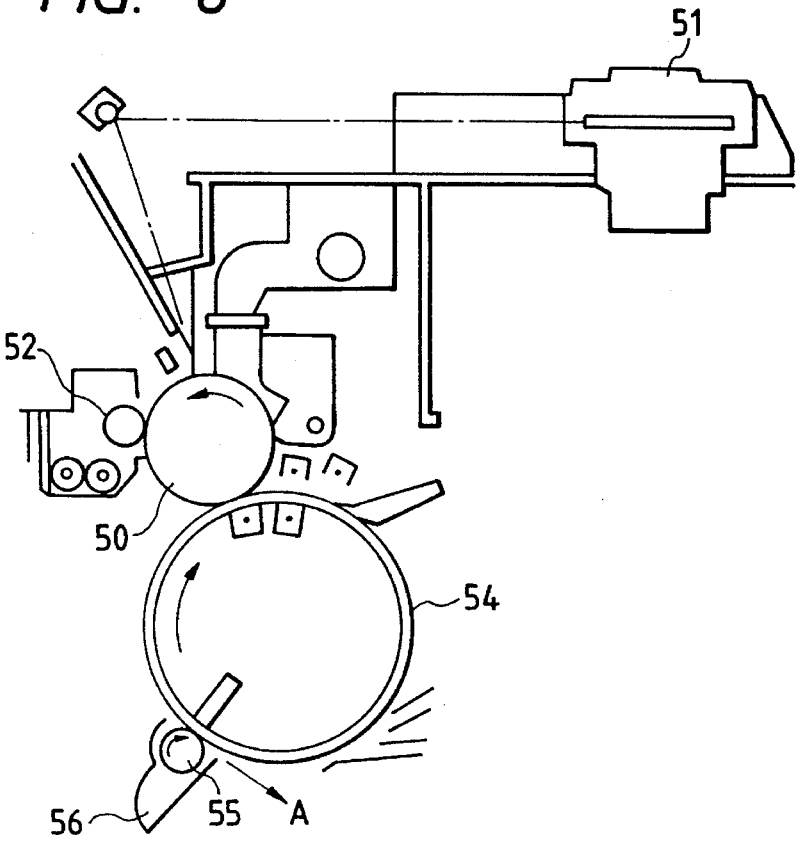
FIG. 6 is a schematic sectional view showing a conventional technique.

Further, in the second embodiment, while an example that the non-woven fabric is merely wound around the metal core was explained, as shown in FIG. 4, a roll cleaner 13*d* may be formed by winding an elastic member $\mathbf{13}d_2$, such as sponge, around a metal core $\mathbf{13}d_1$ and winding non-woven fabric $\mathbf{13}d_3$ around the elastic member. With this arrangement, since the roll cleaner has elasticity, it is possible to provide an adequate nip between the roll cleaner and the transfer drum 6, thereby removing the oil from the transfer drum 6 more effectively.

Next, a third embodiment of the present invention will be explained.

Figure 5:
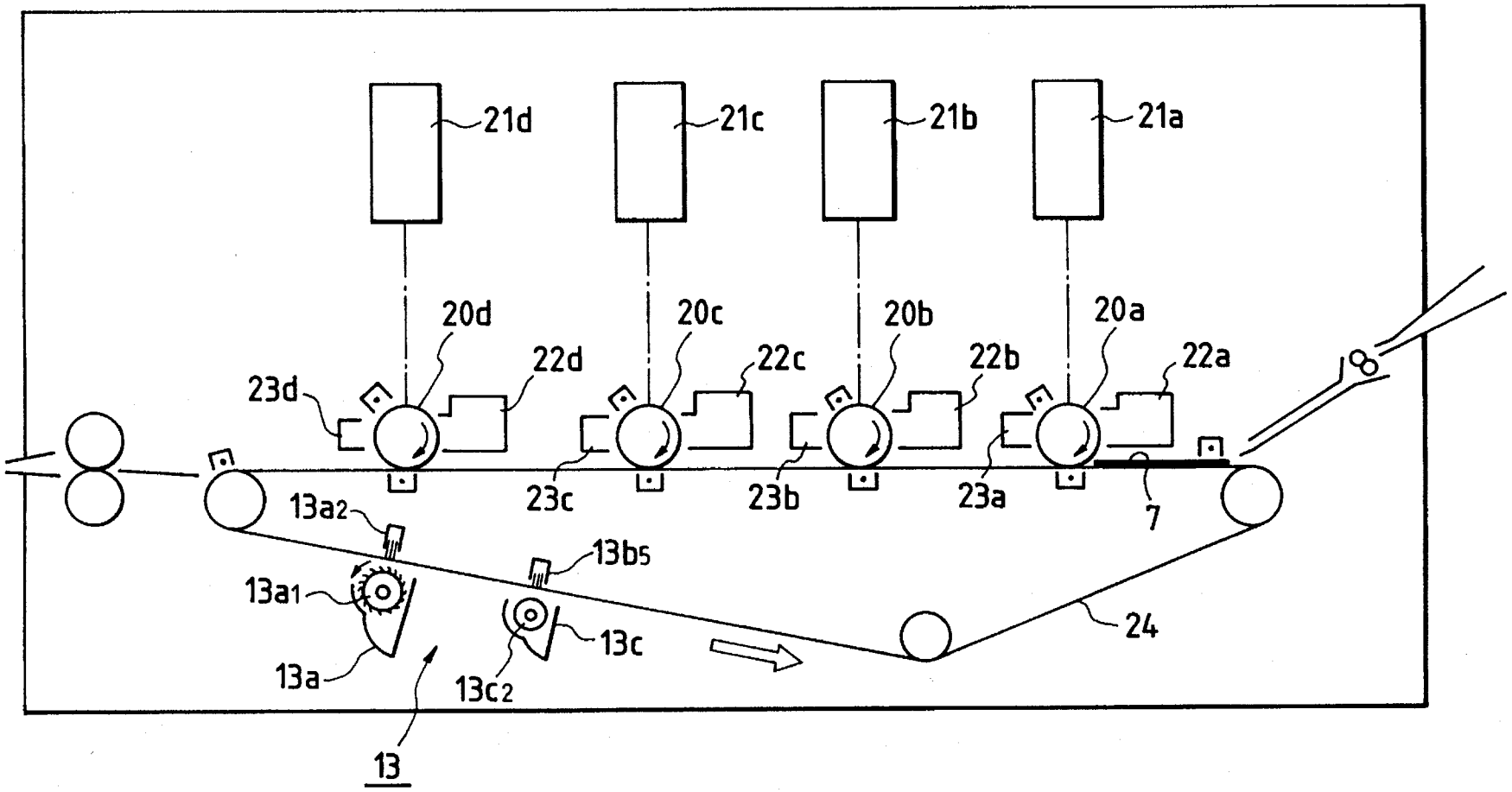
FIG. 5 is a sectional view showing a third embodiment wherein a fur brush cleaner and a roll cleaner are used as a cleaning means for cleaning a transfer belt of an image forming apparatus of transfer belt type.

In the above-mentioned first embodiment, while the image forming apparatus having the drum-shaped recording material bearing member was explained, as shown in FIG. 5, the present invention can be applied to a color image forming apparatus having a belt-shaped recording material bearing member. This image forming apparatus includes four photosensitive drums (image bearing members) 20*a*, 20*b*, 20*c* and 20*d*, exposure means 21*a*, 21*b*, 21*c* and 21*d* for illuminating yellow, magenta, cyan and black color-decomposed light images or equivalent light images onto the respective photosensitive drums to form electrostatic latent images on the drums, developing means 22*a*, 22*b*, 22*c* and 22*d* for visualizing the electrostatic latent images on the photosensitive drums as toner images, and cleaning means 23*a*, 23*b*, 23*c* and 23*d* for removing residual toner (developer) remaining on the photosensitive drums. The electrostatic latent images on the photosensitive drums are successively developed as yellow toner image, magenta toner image, cyan toner image and black toner image, respectively. A recording material 7 is conveyed by an endless transfer belt (recording material bearing member) 24 rotated in a direction shown by the arrow in FIG. 5. The toner images formed on the photosensitive drums are successively transferred onto the recording material 7 in a superimposed fashion in a one-pass manner.

Also in this embodiment, a fur brush cleaner 13*a* and a roll cleaner (second cleaning means) 13*c*, as shown in the second embodiment, are used as a cleaning means for cleaning the transfer belt 24. In this case, when the rotating direction of the transfer belt 24 is the same as the rotating direction of a fur brush $\mathbf{13}a_1$, the roll cleaner 13*c* is arranged at a downstream side of the fur brush cleaner 13*a* in the rotating direction of the transfer belt 24. On the other hand, when the rotating direction of the transfer belt 24 is opposite to the rotating direction of the fur brush $\mathbf{13}a_1$, the roll cleaner 13*c* is arranged at an upstream side of the fur brush cleaner 13*a* in the rotating direction of the transfer belt 24.

With this arrangement, also in the image forming apparatus having the belt-shaped recording material bearing member, the durability of the roll cleaner 13*c* can be increased.

In the above-mentioned embodiments, the fur brush cleaner and the web or roll cleaner were used as the cleaning means for the recording material bearing member to remove the toner and oil adhered to the recording material bearing member. However, the cleaning means for removing the oil is not limited to the web cleaner or the roll cleaner. For example, any cleaner capable of removing the oil adhered to the recording material bearing member can be used.

Further, in the above-mentioned embodiments, while the combination of the fur brush cleaner and the web cleaner and the combination of the fur brush cleaner and the roll cleaner were explained, two or more second cleaning means (other than the fur brush cleaner) may be used.

As mentioned above, according to the present invention, since at least one second cleaning means for removing the oil and the like from the recording material bearing member is provided as well, as the fur brush for cleaning the recording material bearing member, and the second cleaning means is arranged at the side where the toner is hard to be scattered by the rotation of the fur brush, the clogging of the second cleaning means with toner can be prevented. Thus, the durability of the second cleaning means can be increased and the oil adhered to the recording material bearing member can be stably removed for a long time.

The present invention is not limited to the aforementioned embodiments, but various alterations and modifications can be effected within the scope of the invention.

What is claimed is:

1. An image forming apparatus comprising:

image forming means for forming a toner image on a recording material at a recording position;

conveying means having a recording material bearing member for bearing the recording material for conveying the recording material to said recording position, wherein said image forming means and said conveying means form the toner image first on one surface of the recording material and then form the toner image on a second surface of the recording material;

first cleaning means having a rotatably-driven, brush-shaped cleaning member slidingly contacted with a surface of said recording material bearing member for cleaning the surface of said recording material bearing member; and second cleaning means having an oil absorber member abutted against the surface of said recording material bearing member for cleaning the surface of said recording material bearing member, said oil absorber member being abutted against the surface of said recording material bearing member at a side opposite to a side with respect to said brush-shaped cleaning member where the toner is scattered due to the sliding contact between said brush-shaped cleaning member and the surface of said recording material bearing member.

2. An image forming apparatus according to claim 1, wherein said image forming means has an image bearing member for bearing the toner image and transfer means for transferring the toner image from said image bearing member onto the recording material, said image bearing member being contacted with said recording material bearing member at the recording position.

3. An image forming apparatus according to claim 1, further comprising fixing means for fixing the toner image to the recording material, and reverse rotation means for turning over the recording material after a fixing operation so that a surface of the recording material on which the toner image was fixed can be contacted with said recording material bearing member.

4. An image forming apparatus according to claim 1, wherein the image forming apparatus has a first mode in which the toner image is formed on one surface of the recording material, and a second mode in which the toner images are formed on both surfaces of the recording material.

5. An image forming apparatus according to claim 4, wherein said brush-shaped cleaning member and said oil absorber member can be contacted with and separated from said recording material bearing member.

6. An image forming apparatus according to claim 5, wherein said brush-shaped cleaning member and said oil absorber member are contacted with said recording material bearing member after a tip end of the recording material is separated from said recording material bearing member.

7. An image forming apparatus according to claim 6, wherein said brush-shaped cleaning member and said oil absorber member are contacted with said recording material bearing member, respectively, after a trailing end of the recording material passes through a contact position between said brush-shaped cleaning member and said recording material bearing member, and a contact position between said oil absorber member and said recording material bearing member, respectively.

8. An image forming apparatus according to claim 5, wherein, in the first mode, only said brush-shaped cleaning member is contacted with said recording material bearing member, and in the second mode, both of said brush-shaped cleaning member and said oil absorber member are contacted with said recording material bearing member.

9. An image forming apparatus according to claim 1, wherein said brush-shaped cleaning member is moved in a direction opposite to a moving direction of said recording material bearing member at the contact position between said brush-shaped cleaning member and said recording material bearing member.

10. An image forming apparatus according to claim 1, wherein said oil absorber member is moved in the same direction as a moving direction of said recording material bearing member at the contact position between said oil absorber member and said recording material bearing member.

11. An image forming apparatus according to claim 1, wherein said recording material bearing member has a dielectric sheet.

12. An image forming apparatus according to claim 1, wherein said brush-shaped cleaning member is made of nylon.

13. An image forming apparatus according to claim 1, wherein said oil absorber member is formed from non-woven fabric.

14. An image forming apparatus according to claim 13, wherein fibers of said non-woven fabric are synthetic fibers made of nylon and polyester.

15. An image forming apparatus according to claim 1, wherein said brush-shaped cleaning member has a rotatable shape.

16. An image forming apparatus according to claim 1, wherein said oil absorber member has a rotatable shape.

17. An image forming apparatus, comprising:

a recording material bearing member that shifts while bearing a recording material thereon;

image forming means for forming a toner image on the recording material borne on said recording material bearing member, wherein said image forming means forms the toner image first on one surface of the recording material and then form the toner image on a second surface of the recording material;

first cleaning means for cleaning toner attached to a recording material bearing surface of said recording material bearing member at a cleaning position, said first cleaning means having a shift member that shifts while contacting with the cleaning position;

second cleaning means for cleaning oil attached to the recording material bearing surface of said recording material bearing member, said second cleaning means having an oil absorber member contacting with the recording material bearing surface, and being arranged beside said first cleaning means, at a position away from the cleaning position along the recording material bearing surface in an opposite direction from a shifting direction of said shift member at the cleaning position.

18. An image forming apparatus according to claim 17, wherein said second cleaning means is arranged at a position away from an image forming position along the recording material bearing surface in the same direction as the shifting direction of said shifting member at the cleaning position.

19. An image forming apparatus according to claim 17 or 18, wherein said shifting member is a rotary brush.

20. An image forming apparatus according to claim 17 or 18, wherein said image forming means has an image bearing member bearing the toner image thereon, and transfer means for transferring the toner image of the image bearing member to the recording material borne on said recording material bearing member, so that an unfixed toner image is formed on the recording material.

21. An image forming apparatus according to claim 20, further comprising fixing means for fixing the unfixed toner image formed on the recording material, said fixing means having a pair of rotary members for nipping the recording material having the unfixed toner image thereon, wherein the rotary member contacting with the surface of the recording material having the unfixed toner image thereon is coated with oil.

22. An image forming apparatus according to claim 21, wherein said image forming apparatus has a first mode in which, after a toner image is fixed to a first surface of the recording material by said fixing means, no image is formed on a second surface of the recording material, and a second mode in which, after a toner image is formed on the first surface of the recording material by said fixing means, an image is formed on the second surface of the recording material.

23. An image forming apparatus according to claim 22, wherein said second cleaning means cleans said recording material bearing member after completion of image formation on the second surface of the recording material in the second mode, but does not operate in the first mode.

24. An image forming apparatus according to claim 22, wherein said second cleaning means cleans the recording material bearing member after completion of image formation on the second surface of the recording material in the second mode, but does not operate after completion of the image formation to the first surface of the recording material.

25. An image forming apparatus, comprising:

a recording material bearing member that shifts while bearing a recording material thereon;

image forming means for forming a toner image on the recording material borne on said recording material bearing member at an image forming position, wherein said image forming means forms the toner image first on one surface of the recording material and then form the toner image on a second surface of the recording material;

first cleaning means for cleaning toner attached to a recording material bearing surface of said recording material bearing member at a cleaning position, said first cleaning means having a shifting member that shifts while contacting with the cleaning position;

second cleaning means for cleaning oil attached to the recording material bearing surface of said recording material bearing member, said second cleaning means having an oil absorber member contacting with the recording material bearing surface, and being arranged at a position away from the cleaning position along the recording material bearing surface in an opposite direction from a shifting direction of said shifting member at the cleaning position, and at a position away from the image forming position along the recording material bearing surface in the same direction as the shifting direction of said shifting member at the cleaning position.

26. An image forming apparatus according to claim 25, wherein said shifting member is a rotary brush.

27. An image forming apparatus according to claim 25 or 26, wherein said image forming means has an image bearing member bearing the toner image thereon, and transfer means for transferring the toner image of the image bearing member to the recording material borne on said recording material bearing member, so that an unfixed toner image is formed on the recording material.

28. An image forming apparatus according to claim 27, further comprising fixing means for fixing the unfixed toner image formed on the recording material, said fixing means having a pair of rotary members for nipping the recording material having the unfixed toner image thereon, wherein the rotary member contacting with the surface of the recording material having the unfixed toner image thereon is coated with oil.

29. An image forming apparatus according to claim 28, wherein said image forming apparatus has a first mode in which, after a toner image is fixed to a first surface of the recording material by said fixing means, no image is formed on a second surface of the recording material, and a second mode in which, after a toner image is formed on the first surface of the recording material by said fixing means, an image is formed on the second surface of the recording material.

30. An image forming apparatus according to claim 29, wherein said second cleaning means cleans said recording material bearing member after completion of image formation on the second surface of the recording material in the second mode, but does not operate in the first mode.

31. An image forming apparatus according to claim 29, wherein said second cleaning means cleans the recording material bearing member after completion of image formation on the second surface of the recording material in the second mode, but does not operate after completion of the image formation to the first surface of the recording material.

32. An image forming apparatus comprising:

image forming means for forming a toner image on a recording material at a recording position;

a recording material bearing member for bearing the recording materials, wherein said image forming means forms the toner image first on one surface of the recording material and then form the toner image on a second surface of the recording material;

first cleaning means having a shifting member slidingly contacted with a surface of said recording material bearing member for cleaning a surface thereof; and second cleaning means having a rotatable oil absorbing member abutted against the surface of said recording material bearing member for cleaning the surface thereof, said oil absorbing member being abutted against the surface of said recording material bearing member at a side opposite to a side where the toner is scattered due to the sliding contact between said shifting member and the surface of said recording material bearing member.

33. An image forming apparatus according to claim 32, wherein said image forming means has an image bearing member for bearing the toner image and transfer means for transferring the toner image from said image bearing member onto the recording material, said image bearing member being contacted with said recording material bearing member at the recording position.

34. An image forming apparatus according to claim 32, further comprising fixing means for fixing the toner image to the recording material, and reverse rotation means for turning over the recording material after a fixing operation so that a surface of the recording material on which the toner image was fixed can be contacted with said recording material bearing member.

35. An image forming apparatus according to claim 32, wherein said image forming apparatus has a first mode in which the toner image is formed on one surface of the recording material, and a second mode in which the toner images are formed on both surfaces of the recording material.

36. An image forming apparatus according to claim 35, wherein said shifting member and said oil absorbing member can be contacted with and separated from said recording material bearing member.

37. An image forming apparatus according to claim 36, wherein said shifting member and said oil absorbing member are contacted with said recording material bearing member, after a tip end of the recording material is separated from said recording material bearing member.

38. An image forming apparatus according to claim 37, wherein said shifting member and said oil absorbing member are contacted with said recording material bearing member, respectively, after a trailing end of the recording material passes through a contact position between said shifting member and said recording material bearing member, and a contact position between said oil absorbing member and said recording material bearing member, respectively.

39. An image forming apparatus according to claim 36, wherein, in the first mode, only said shifting member is contacted with said recording material bearing member, and in the second mode, both of said shifting member and said oil absorbing member are contacted with said recording material bearing member.

40. An image forming apparatus according to claim 32, wherein said shifting member is moved in a direction opposite to a moving direction of said recording material bearing member at the contact position between said shifting member and said recording material bearing member.

41. An image forming apparatus according to claim 32, wherein said oil absorbing member is moved in the same direction as a moving direction of said recording material bearing member at the contact position between said oil absorbing member and said recording material bearing member.

42. An image bearing apparatus according to claim 32, wherein said recording material bearing member has a dielectric sheet.

43. An image forming apparatus according to claim 32, wherein said shifting member has a brush-like configuration.

44. An image forming apparatus according to claim 43, wherein said shifting member is made of nylon.

45. An image forming apparatus according to claim 32, wherein said oil absorbing member is a roller.

46. An image forming apparatus according to claim 45, wherein said oil absorbing member has a non-woven fabric on a surface thereof.

47. An image forming apparatus according to claim 46, wherein fibers of said non-woven fabric are synthetic fibers made of nylon and polyester.

48. An image forming apparatus according to claim 32, wherein said shifting member has a rotatable shape.

49. An image forming apparatus, comprising:

a recording material bearing member for bearing a recording material thereon;

image forming means for forming a toner image on the recording material borne on said recording material bearing member, wherein said image forming means forms the toner image first on one surface of the recording material and then form the toner image on a second surface of the recording material;

first cleaning means for cleaning toner attached to a recording material bearing surface of said recording material bearing member at a cleaning position, said first cleaning means having a shifting member shifting while contacting with the cleaning position;

second cleaning means for cleaning oil attached to the recording material bearing surface of said recording material bearing member, said second cleaning means having a rotatable oil absorbing member contacting with the recording material bearing surface, and being arranged beside said shifting member, at a position away from the cleaning position along the recording material bearing surface in an opposite direction from a shifting direction of said shifting member at the cleaning position.

50. An image forming apparatus according to claim 49, wherein said second cleaning means is arranged at a position away from an image forming position along the recording material bearing surface in the same direction as the shifting direction of said shifting member at the cleaning position.

51. An image forming apparatus according to claim 49 or 50, wherein said oil absorbing member is a roller.

52. An image forming apparatus according to claim 49 or 50, wherein said shifting member is a rotary brush.

53. An image forming apparatus according to claim 49 or 50, wherein said image forming means has an image bearing member bearing the toner image thereon, and transfer means for transferring the toner image of said image bearing member to the recording material borne on said recording material bearing member, so that an unfixed toner image is formed on the recording material.

54. An image forming apparatus according to claim 53, further comprising fixing means for fixing the unfixed toner image formed on the recording material, said fixing means having a pair of rotary members for nipping the recording material on which the unfixed toner image is formed, wherein the rotary member contacting with the surface of the recording material having the unfixed toner image thereon is coated with oil.

55. An image forming apparatus according to claim 53, wherein said image forming apparatus has a first mode in which, after a toner image is fixed to a first surface of the recording material by said fixing means, no image is formed on a second surface of the recording material, and a second mode in which, after a toner image is formed on the first surface of the recording material by said fixing means, an image is formed on the second surface of the recording material.

56. An image forming apparatus according to claim 55, wherein said second cleaning means cleans said recording material bearing member after completion of image formation on the second surface of the recording material in the second mode, but does not operate in the first mode.

57. An image forming apparatus according to claim 55, wherein said second cleaning means cleans the recording material bearing member after completion of image formation on the second surface of the recording material in the second mode, but does not operate after completion of the image formation on the first surface of the recording material.

58. An image forming apparatus according to claim 53, wherein a plurality of colors of toner images are sequentially borne on said image bearing member, to be superimposedly transferred onto the recording material borne on said recording material bearing member.

59. An image forming apparatus, comprising:

a recording material bearing member for bearing a recording material thereon;

image forming means for forming a toner image on the recording material borne on said recording material bearing member at an image forming position, wherein said image forming means forms the toner image first on one surface of the recording material and then form the toner image on a second surface of the recording material;

first cleaning means for cleaning toner attached to a recording material bearing surface of said recording material bearing member at a cleaning position, said first cleaning means having a shifting member shifting while contacting with the cleaning position;

second cleaning means for cleaning oil attached to a recording material bearing surface of said recording material bearing member, said second cleaning means having a rotatable oil absorbing member contacting with the recording material bearing surface, and being arranged at a position away from the cleaning position along the recording material bearing surface in an opposite direction from a shifting direction of said shifting member at the cleaning position, and at a position away from the image forming position along the recording material bearing surface in the same direction as the shifting direction of said shifting member at the cleaning position.

60. An image forming apparatus according to claim 59, wherein said oil absorbing member is a roller.

61. An image forming apparatus according to claim 59, wherein said shifting member is a rotary brush.

62. An image forming apparatus according to claim 59, wherein said image forming means has an image bearing member bearing the toner image thereon, and transfer means for transferring the toner image of said image bearing member to the recording material borne on said recording material bearing member, so that an unfixed toner image is formed on the recording material.

63. An image forming apparatus according to claim 62, further comprising fixing means for fixing the unfixed toner image formed on the recording material, said fixing means having a pair of rotary members for nipping the recording material on which the unfixed toner image is formed, wherein the rotary member contacting with the surface of the recording material having the unfixed toner image thereon is coated with oil.

64. An image forming apparatus according to claim 62, wherein said image forming apparatus has a first mode in which, after a toner image is fixed to a first surface of the recording material by said fixing means, no image is formed on a second surface of the recording material, and a second mode in which, after a toner image is formed on the first surface of the recording material by said fixing means, an image is formed on the second surface of the recording material.

65. An image forming apparatus according to claim 64, wherein said second cleaning means cleans said recording material bearing member after completion of image formation on the second surface of the recording material in the second mode, but does not operate in the first mode.

66. An image forming apparatus according to claim 64, wherein said second cleaning means cleans the recording material bearing member after completion of image formation on the second surface of the recording material in the second mode, but does not operate after completion of the image formation on the first surface of the recording material.

67. An image forming apparatus according to claim 62, wherein a plurality of colors of toner images are sequentially borne on said image bearing member, to be superimposedly transferred onto the recording material borne on said recording material bearing member.

68. An image forming apparatus according to claim 63, wherein a plurality of colors of toner images are sequentially borne on said image bearing member, to be superimposedly transferred onto the recording material borne on said recording material bearing member.

* * * * *

UNITED STATES PATENT AND TRADEMARK OFFICE

CERTIFICATE OF CORRECTION

PATENT NO. : 5,619,314
DATED : April 8, 1997
INVENTOR(S) : Takahiro KUBO

It is certified that error appears in the above-identified patent and that said Letters Patent is hereby corrected as shown below:

Column 4

Line 3, "born" should read --borne--.

Column 6

Line 17, "born" should read --borne--.

Column 8

Line 7, "well, as" should read --well as--.

Column 10

Line 58, "form" should read --forms--.

Column 11

Line 54, "materials," should read --material,--.

Line 57, "form" should read --forms--.

UNITED STATES PATENT AND TRADEMARK OFFICE

CERTIFICATE OF CORRECTION

PATENT NO. : 5,619,314
DATED : April 8, 1997
INVENTOR(S) : Takahiro KUBO

It is certified that error appears in the above-identified patent and that said Letters Patent is hereby corrected as shown below:

Column 13

Line 17, "form" should read --forms--.

Signed and Sealed this

Twenty-eighth Day of October, 1997

*Attest:*

Bruce Lehman

BRUCE LEHMAN

*Attesting Officer*

*Commissioner of Patents and Trademarks*